United States Patent [19]

Koffski

[11] 4,296,835

[45] Oct. 27, 1981

[54] BRACKET

[76] Inventor: Leonard E. Koffski, R.R. #4, 7534 Trans Canada Hwy., Duncan, British Columbia, Canada, V9L 3W8

[21] Appl. No.: 50,558

[22] Filed: Jun. 21, 1979

Related U.S. Application Data

[63] Continuation-in-part of Ser. No. 916,143, Jun. 16, 1978.

[51] Int. Cl.[3] ..... F16M 11/00

[52] U.S. Cl. ..... 182/184; 182/185; 182/204; 182/224

[58] Field of Search ..... 182/181-186, 182/224, 225, 226, 201-205; 248/188.2, 188.1, 188.5

[56] References Cited

U.S. PATENT DOCUMENTS

| | | | |
|---|---|---|---|
| 351,143 | 10/1886 | Whittingham | 182/187 |
| 1,271,095 | 7/1918 | Staines | 182/184 |
| 2,583,437 | 1/1952 | Newlon | 182/181 |
| 2,891,819 | 6/1959 | Jackson | 182/184 |

FOREIGN PATENT DOCUMENTS

| | | | |
|---|---|---|---|
| 558116 | 2/1957 | Italy | 182/204 |

*Primary Examiner*—Reinaldo P. Machado
*Attorney, Agent, or Firm*—Stevens, Davis, Miller & Mosher

[57] ABSTRACT

A bracket for carrying a plank by means of support legs. The bracket has a cross piece of predetermined length to carry the plank. Open faced channel members are connected at each end of the cross piece. These members extend downwardly and outwardly. The open faces of the channel members open in opposite directions and in the direction of the length of the cross piece. The channel members have internally rounded corners. A bracket sleeve is pivotally connected to each of the channel members for receiving and retaining support legs. The sleeve may be formed with, for example, teeth on one edge to engage the retained leg.

12 Claims, 4 Drawing Figures

BRACKET

CROSS REFERENCE AND RELATED APPLICATION

This application is a continuation-in-part of my application 916,143 filed June 16, 1978.

FIELD OF THE INVENTION

This invention relates to a bracket useful to carry a plank to form a free-standing structure.

DESCRIPTION OF PRIOR ART

The formation of scaffolding as an aid in construction work generally and in cleaning is well known. Generally speaking scaffolding has either been relatively complex in structure or, at least, difficult to put up, particularly in large industrial scaffolding such as would be used in the refinishing of a building surface. However, even with small buildings, for example, houses, scaffolding structures have been relatively complex and have involved in many instances the mounting of the scaffolding on a wall of the house. Inside the house it is generally preferred to use step-ladders rather than to use scaffolding that must be located on the wall of a room. However, the use of scaffolding, which permits the use of a plank or similar platform, is clearly described in internal work in a house as far greater areas can be dealt with without adjustments such as having to move a step ladder.

SUMMARY OF THE INVENTION

The present invention seeks to provide brackets useful to carry a plank and thus form a free-standing structure on legs, that is a structure that does not need to be located on a wall.

Accordingly, in a first aspect the present invention is a bracket for carrying a plank by means of support legs comprising: (a) a cross piece of predetermined length for carrying a plank; (b) respective open faced channel members connected at each end of said cross piece and extending downwardly and outwardly therefrom, the open faces of said channel members opening in opposite directions and in the direction of the length of said cross piece, said channel members having internally rounded corners; and (c) a bracket sleeve pivotally connected to each of the channel members for receiving and retaining support legs in a stationary position relative to said channel members.

Preferably there are engagement means, for example teeth, on an edge of the sleeve bracket to dig into and thus assist in holding the support leg.

The above bracket may include upstanding members at each end of the cross piece to maintain a plank in position on the cross piece. The plank would, of course, extend to another bracket, spaced from the first bracket, to provide a free-standing scaffold or structure.

The open-faced channel members are able to receive a leg of substantially rectangular cross sections. The bracket sleeve is pivotally mounted on the back of the channel and extends around and across the open face to contact the leg. An advantage of the rectangular cross section is that a simple piece of two-by-four lumber can be used to form the legs and such lumber is freely available on any building site or any lumber yard.

The channels extend outwardly and downwardly from the cross piece in order to provide a stable structure and to assist engagement by the sleeve. That is this arrangement of the channels is preferably such that the substantially flat back portions of the open faced channels at each end of the cross piece reside in respective planes, the planes of the back members intersecting at a line perpendicular to the cross piece above and midway of said cross piece.

Furthermore, the cross pieces should be inclined relative to the pathways so the legs extend longitudinally and outwardly downwardly when a platform is in position. This again provides a more stable structure and assists engagement by the sleeve. This arrangement is such that the channels are aligned on opposite sides of said cross piece in a first plane and the cross piece has a top surface aligned in a second plane, said first plane being inclined relative to said second plane.

BRIEF DESCRIPTION OF THE DRAWINGS

Aspects of the invention are illustrated, merely by way of example, in the accompanying drawings, in which.

DESCRIPTION OF THE PREFERRED EMBODIMENTS

Figure 1:
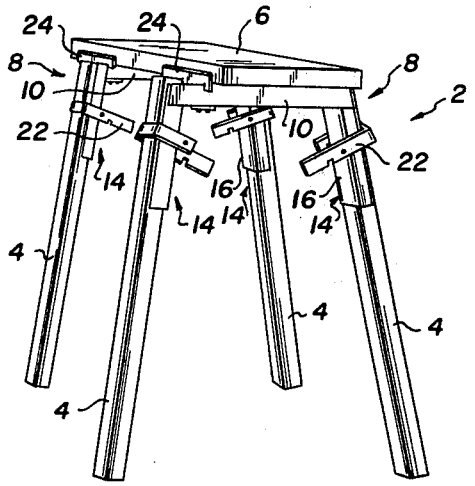
FIG. 1 is a view of a free-standing structure using four brackets of the present invention.
Figure 2:
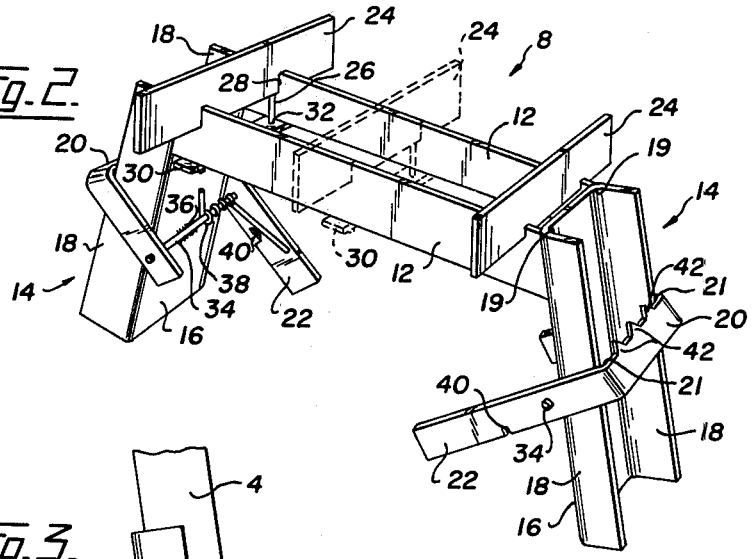
FIG. 2 is a perspective view of a bracket used in the free-standing structure of FIG. 1.
Figure 3:
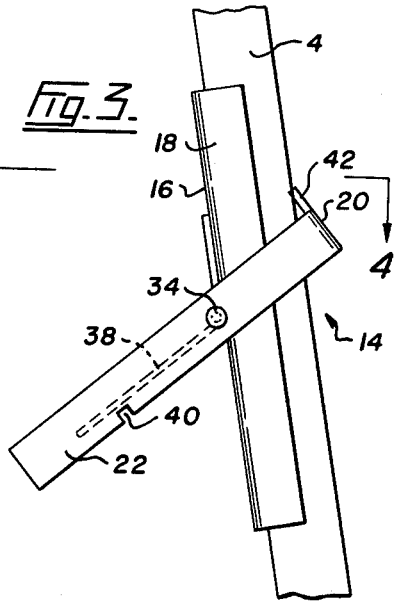
FIG. 3 is a detail of FIG. 1.

The drawings show a free-standing structure 2 having legs 4 adjacent each corner and carrying a plank 6. There are brackets 8 supporting the legs 4 in position, one bracket 8 at each end of the plank 6. As illustrated in FIGS. 1 and 2 each bracket 8 comprises a cross piece 10 to carry the platform 6. Cross piece 10 comprises spaced bars 12 in FIG. 2. There are means defining a pathway to receive a leg 4 at each end of the cross piece 10. In FIGS. 1 and 2 the means comprises an open channel member 14 having a back 16 and sides 18 and able to receive a leg 4 of substantially rectangular cross section, for example, a piece of common two-by-four lumber. The internal corners of the member 14 are rounded to 19—see FIG. 4 in particular.

Figure 4:
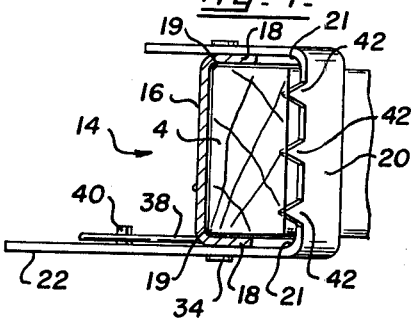
FIG. 4 is a section on the line 4—4 of FIG. 3.

There is a sleeve 20 in the form of a substantially U-shaped bracket formed on the back 16 of the open-faced channel 14 to extend, as illustrated in FIG. 1, around a leg 4. The internal corners of the sleeve 20 are rounded to 21—see FIG. 4. A lever 22 extends from the sleeve 20 to permit pivoting of the sleeve 20 to grip a leg 4 in position in said pathway and, as described later, to permit the bracket 8 to be moved up and down a leg 4. The channel 14 and sleeve 20 have rounded corners to contact the leg 4. This facilitates the gripping action as the point of contact of the corners of leg 4 with the channel member and sleeve is concentrated at the rounded corners and allows for variation in the size of the legs for example if a piece of wet lumber is used that was swollen. As shown in FIG. 4, the contact of the corners of leg 4 with the rounded corners of the channel member 14 causes the spacing of leg 4 from the back 16 of the channel member 14. This rounded internal corner feature is of greater importance for the channel member 14 than for the sleeve 20.

There are upstanding members 24 at each end of the cross piece 10 to maintain the platform 6 in position on the cross piece 10. As shown particularly in FIG. 2 one such upstanding member may be attached by welding to the cross piece 10 but the other is desirably provided with downwardly extending studs 26 and is provided with recesses 28 to fit over the spaced bars 12 that form the cross piece 10. There is a bar 30 provided with holes 32 to receive the studs 26. Nuts are engaged on the studs 26 to lock the bracket 30 against the bars 12 and thus locate the movable upstanding member 24 at a desired position.

The sleeve 20 is pivotally mounted on a rod 34 welded at 36 to the back 16 of the channel 14. There is a spring 38 that abuts the back 16 of the channel 14 and a projection 40 on the lever 22 attached to the sleeve 20. The spring 38 urges the sleeve 20 to the position shown in FIG. 2.

There are teeth 42 formed on an upper edge of the bracket sleeve 14. The teeth 42 dig into leg 4 and can be useful in providing firm contact. Three teeth are shown but any number is suitable.

The relative positions of the channels 14 and the cross pieces 10 are such that the legs extend outwardly and downwardly from the cross pieces 10 and away from each other. This disposition of the legs 4 is shown particularly in FIG. 1.

To use the bracket illustrated in FIG. 2 to produce the structure illustrated in FIG. 1 the legs 4 are positioned within the channels 14. The levers 22 of the sleeves 20 are urged upwardly from the position shown in FIG. 2 so that the fronts of the sleeves 20 are at the maximum possible distance from the backs 16 of the channels 14. This facilitates introduction of the legs 4 into the channels 14. With leg 4 positioned in each channel 14, the levers 22 are released to assume the position shown in FIG. 2. Each bracket 8 may then be raised up a leg 4 by forcing lever 22 upwardly. This moves the sleeve 20 around the pivot point defined by the point on leg 4 where the sleeve 20 contacts the leg 4. At the uppermost position of the lever 22 the lever may be released and the spring 38 will urge it back to the position shown in FIG. 2. The movement may then be repeated until the bracket has been moved up a leg 4 a sufficient height. It will, of course, be appreciated that each channel may be positioned independently for each leg. 4. Thus, the device is useful on ground that is not level and, furthermore, can also be arranged so that the platform 6 is sloped. The arrangement of the sleeve 20 and of the disposition of the legs 4 relative to the platform 6 ensures an extremely stable structure, easily able to carry considerable loads.

The rounding of corners at 19 and 21, particularly at 19, where the back 16 meets the sides 18 of the channel member 14 facilitates the gripping action as do the teeth 42.

I claim:

1. A bracket for carrying a plank by means of support legs, which have a predetermined rectangular cross sectional configuration, comprising:

(a) a cross piece of predetermined length for carrying a plank;

(b) respective open faced channel members connected at each end of said cross piece and extending downwardly and outwardly therefrom, the open faces of said channel members opening in opposite directions and in the direction of the length of said cross piece, said channel members having a pair of internally rounded corners and an internal cross sectional widthwise dimension slightly larger than the widthwise dimension of said support legs such that said support legs engage with said channel members by respective contact of two corners of said support legs with the pair rounded corners of said channel members when said support legs are inserted in said channel members; and (c) a bracket sleeve pivotally connected to each of the channel members for receiving and retaining support legs in a stationary position relative to said channel members.

2. A bracket for carrying a plank by means of support legs comprising:

(a) a continuous cross piece of predetermined length for carrying a plank on a top surface thereof;

(b) respective channel members connected at each end of the cross piece to extend downwardly and outwardly therefrom for receiving support legs, said channel members being open faced and opening outwardly in the direction of the length of said cross piece and having a U-shape, said channel members being aligned across said cross piece in a first plane and the top surface of said cross piece residing in a second plane, said first plane being inclined relative to said second plane, said channel members also residing in respective third and fourth planes located on opposite sides of said cross piece which interset at a point above and substantially midway of said cross piece; and, (c) respective bracket sleeves pivotally connected to each of the channel members for receiving support legs therein and retaining the support legs in a stationary position within respective channel members, each said bracket sleeve including at least one tooth on the edge thereof for engaging with a support leg.

3. A bracket for carrying a plank by means of support legs comprising:

(a) a cross piece of predetermined length for carrying a plank;

(b) respective open faced channel members connected at each end of said cross piece and extending downwardly and outwardly therefrom, the open faces of said channel members opening in opposite directions and in the direction of the length of said cross piece, one upper end of each said channel members being substantially at the same level as the top of said cross piece, said channel members and connected cross piece taking the shape of an inverted U when said cross piece carries a plank thereon; and (c) a bracket sleeve pivotally connected to each of the channel members for receiving and retaining support legs in a stationary position relative to said channel members, each said bracket sleeve including at least one tooth on an edge thereof for engaging with a support leg.

4. A bracket for carrying a plank by means of support legs comprising:

(a) a cross piece of predetermined length for carrying a plank;

(b) respective support leg pathways connected at opposite ends of said cross piece and extending downwardly and outwardly therefrom for retaining support legs;

(c) respective bracket sleeves pivotally connected to said pathways for receiving and retaining the support legs in stationary position relative to said pathways, each said bracket sleeve including at least one tooth on an edge thereof for engaging with a support leg; and (d) a manually operable handle connected to each of said bracket sleeves for pivotally moving said bracket sleeves, said handles extending towards one another and inwardly of said bracket and being located on opposite widthwise sides of said cross piece.

5. A bracket for carrying a plank by means of support legs comprising:

(a) a cross piece of predetermined length for carrying a plank on a top surface thereof;

(b) respective members connected at each end of the cross piece to extend downwardly and outwardly therefrom for receiving support legs, said members being aligned across said cross piece in a first plane and the top surface of said cross piece residing in a second plane, said members also residing in respective third and fourth planes located on opposite sides of said cross piece which intersect at a point above and substantially midway of said cross piece; and (c) respective bracket sleeves pivotally connected to each of the members for receiving support legs therein and retaining the support legs in a stationary position relative to respective members, each said bracket sleeve including at least one tooth on an edge thereof for engaging with a support leg.

6. A bracket for carrying a plank by means of support legs comprising:

(a) a cross piece of predetermined length for carrying a plank;

(b) respective channel members connected to each end of the cross piece to extend downwardly and outwardly therefrom for receiving support legs; and (c) respective bracket sleeves pivotally connected to each of the channel members for receiving and retaining the support legs in stationary position within respective channel members, each said bracket sleeve being mounted for pivotal movement on a pivot rod attached to the back of a respective channel member, a spring being provided around said pivot rod for biasing said bracket sleeve to a position where it grips a leg placed within a respective channel member, each said bracket sleeve further including at least one tooth on an edge thereof for engaging with a support leg.

7. A bracket for carrying a plank as in claims 2, 3, 4, 5 or 6 wherein said support legs have a predetermined rectangular cross sectional configuration and said channel members have a pair of internally rounded corners and an internal cross sectional widthwise dimension slightly larger than the width wise dimension of said support legs such that said support legs engage with said channel members by respective contact of two corners of a said support leg with the pair of rounded corners of a said channel member when said support legs are inserted into said channel members.

8. A bracket for carrying a plank by means of support legs, which have a predetermined rectangular cross section configuration, comprising:

(a) a cross piece of predetermined length for carrying a plank;

(b) respective open faced channel members connected at each end of said cross piece and extending downwardly and outwardly therefrom, the open faces of said channel members opening in opposite directions in the direction of the length of said cross piece, said channel members having a pair of internally rounded corners and an internal cross sectional widthwise dimension slightly larger than the width wise dimension of said support legs such that said support legs engage with said channel members by respective contact of two corners of said support legs with the pair rounded corners of said channel members when said support legs are inserted in said channel members; and (c) means coupled to said channel members for holding said two corners of said support legs in contact with said rounded corners of said channel members.

9. A bracket for carrying a plank by means of support legs which have a predetermined rectangular cross sectional configuration comprising:

(a) a continuous cross piece of predetermined length for carrying a plank on a top surface thereof;

(b) respective channel members connected at each end of the cross piece to extend downwardly and outwardly therefrom for receiving support legs, said channel members being open faced and opening outwardly in the direction of the length of said cross piece and having a U-shape, said channel members being aligned across said cross piece in a first plane and the top surface of said cross piece residing in a second plane, said first plane being inclined relative to said second plane, said channel members also residing in respective third and fourth planes located on opposite sides of said cross piece which intersect at a point above and substantially midway of said cross piece, said channel members having internally rounded corners and an internal cross sectional widthwise dimension slightly larger than the widthwise dimension of said support legs such that said support legs engage with said channel members by respective contact of two corners of said support legs with the pair rounded corners of said channel members when said support legs are inserted in said channel members; and, (c) respective bracket sleeves pivotally connected to each of the channel members for receiving support legs therein and retaining the support legs in a stationary position within respective channel members.

10. A bracket for carrying a plank by means of support legs, which have a predetermined cross sectional configuration, comprising:

(a) a cross piece of predetermined length for carrying a plank;

(b) respective open faced channel members connected at each end of said cross piece and extending downwardly and outwardly therefrom, the open faces of said channel members opening in opposite directions and in the direction of the length of said cross piece, one upper end of each said channel member being substantially at the same level as the top of said cross piece, said channel members and connected cross piece taking the shape of an inverted U when said cross piece carries a plank thereon, said channel members having internally rounded corners and an internal cross sectional widthwise dimension slightly larger than the widthwise dimension of said support legs such that said support legs engage with said channel members by respective contact of two corners of a said support leg with the pair rounded corners of a said channel member when said support legs are inserted in said channel members; and, (c) a bracket sleeve pivotally connected to each of the channel members for receiving and retaining support legs in a stationary position relative to said channel members.

11. A bracket for carrying a plank by means of support legs which have a predetermined cross sectional configuration comprising:

(a) a cross piece of predetermined length for carrying a plank;

(b) respective channel members connected to each end of the cross piece to extend downwardly and outwardly therefrom for receiving support legs, said channel members having internally rounded corners and an internal cross sectional widthwise dimension slightly larger than the widthwise dimension of said support legs such that said support legs engage with said channel members by respective contact of two corners of a said support leg with the pair rounded corners of a said channel member when said support legs are inserted in said channel members; and (c) respective bracket sleeves pivotally connected to each of the channel members for receiving and retaining the support legs in stationary position within respective channel members, each said bracket sleeve being mounted for pivotal movement on a pivot rod attached to the back of a respective channel member, a spring being provided around said pivot rod for biasing said bracket sleeve to a position where it grips a leg placed within a respective channel member.

12. A bracket for carrying a plank as in claims 1, 9, 10 or 11 wherein said bracket sleeves have internally rounded corners for engaging with two other corners of said support legs.

* * * * *